US007828079B2

(12) United States Patent
Oothoudt

(10) Patent No.: US 7,828,079 B2
(45) Date of Patent: Nov. 9, 2010

(54) SONIC WIRELINE DRY SLOUGH BARREL

(75) Inventor: Thomas J Oothoudt, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 116 days.

(21) Appl. No.: 12/345,329

(22) Filed: Dec. 29, 2008

(65) Prior Publication Data

US 2009/0277688 A1 Nov. 12, 2009

Related U.S. Application Data

(60) Provisional application No. 61/052,568, filed on May 12, 2008.

(51) Int. Cl.

| | |
|---|---|
| ***E21B 31/08*** | (2006.01) |
| ***E21B 10/02*** | (2006.01) |
| ***E21B 10/36*** | (2006.01) |
| ***E21B 12/06*** | (2006.01) |

(52) U.S. Cl. ..... 175/20; 175/244; 175/293; 166/99

(58) Field of Classification Search ..... 175/51, 175/244, 249, 251, 293, 20, 135, 405; 166/99, 166/311

See application file for complete search history.

(56) References Cited

U.S. PATENT DOCUMENTS

| | | | | |
|---|---|---|---|---|
| 52,853 | A * | 2/1866 | Howe | 175/405 |
| 1,078,064 | A * | 11/1913 | Rand | 175/98 |
| 2,214,970 | A * | 9/1940 | Mooney | 175/242 |
| 2,795,395 | A * | 6/1957 | Acker, Jr. et al. | 175/239 |
| 2,807,439 | A * | 9/1957 | Lipscomb | 175/6 |
| 3,194,328 | A * | 7/1965 | Fiore | 175/92 |
| 3,696,873 | A * | 10/1972 | Anderson | 175/20 |
| 2003/0205408 | A1 * | 11/2003 | Lee et al. | 175/20 |

* cited by examiner

*Primary Examiner*—Kenneth Thompson
(74) *Attorney, Agent, or Firm*—Workman Nydegger

(57) ABSTRACT

Slough removal assemblies and methods for removing slough from boreholes are described. A slough removal assembly containing a slough barrel is lowered into a borehole having excess slough, driven into the slough to cause the slough to enter the slough barrel, and the slough removal assembly is then removed along with the excess slough. The slough removal assembly may contain a shoe coupled to the slough barrel and configured to be driven into the slough, a retainer positioned between the shoe and the slough barrel to retain slough inside of the slough barrel, and a driving mechanism (such as a drop hammer) to drive the slough assembly into the slough. The slough removal assembly may be coupled either to a wireline system or to a drill string for insertion into and removal from the borehole.

27 Claims, 5 Drawing Sheets

SONIC WIRELINE DRY SLOUGH BARREL

CROSS-REFERENCE TO RELATED APPLICATIONS

This application claims the benefit of U.S. Provisional Patent Application Ser. No. 61/052,568 filed May 12, 2008, entitled "Sonic Wireline Dry Slough Barrel," which is incorporated herein by reference.

BACKGROUND OF THE INVENTION

1. The Field of the Invention

This application relates generally to drilling methods and devices used in drilling. In particular, this application relates to a method and apparatus for slough removal from a borehole that is created during drilling.

2. The Relevant Technology

Many drilling processes are currently known and used. One type of drilling process, exploration drilling, often includes retrieving a sample of a desired material from below the surface of the earth. In a conventional process used in exploration drilling, an open-faced drill bit is attached to the bottom or leading edge of a core barrel for retrieving the desired sample. The core barrel is then attached to a drill string, which is a series of connected drill rods that are assembled section by section as the core barrel moves deeper into the formation. The core barrel is rotated and/or pushed into the desired sub-surface formation to obtain a sample of the desired material (often called a core sample). Once the sample is obtained, the core barrel containing the core sample is retrieved by removing (or tripping out) the entire drill string out of the hole that has been drilled (the borehole). Each section of the drill rod must be sequentially removed from the borehole. The core sample can then be removed from the core barrel.

An outer casing with a larger diameter than the core barrel can be used to maintain an open borehole. Like the core barrel, the casing contains an open-faced drill bit that is connected to a drill string, but both with a wider diameter than the core barrel (and the drill string used with the core barrel). The outer casing is advanced and removed in the same manner as the core barrel, i.e., by tripping the sections of the drill rod in and out. Typically, though, where the casing is used in conventional exploration drilling, it creates a borehole first through which the core barrel (along with its drill string) is used.

In a wireline exploration drilling process, however, the core barrel and the casing are advanced together into the formation. The casing again has a drill bit connected to a drill string and is advanced into the formation. But the core barrel does not contain a drill bit and is not connected to a drill string. Instead, the core barrel rests just inside and on the casing and advances into the formation along with the casing. When the core sample is obtained, the core barrel is retrieved using a wireline system as known in the art, the core sample is removed, and the core barrel is dropped back into the casing using the wireline system. Thus, the wireline system removes the time needed to trip the drill rods in and out of the borehole when obtaining a core sample.

In sonic drilling processes used in exploration drilling, whether conventional or wireline, variable frequency vibration is created by an oscillator that is mechanically induced to the drill string of the core barrel and/or casing. The vibration is transmitted in an axial direction down through the drill string to the open-faced drill bit. The drill string may optionally be rotated and mechanically pushed as it is vibrated into the sub-surface formation.

These drilling processes can have several drawbacks. One of these drawbacks is slough creation. Slough is that material that is displaced by the drill bit, or other material that falls into the borehole. Excess slough will take the path of the least resistance during drilling processes. As a result, the slough will enter the core barrel which can cause disturbed, elongated, compacted, and in some cases, heated core samples. The slough can also be pushed outward into the formation, causing compaction of the formation and alter its natural state, which in turn can cause contamination of the core sample with material that does not belong to the depth of the formation being tested. Additionally, the slough can also enter the annular space between the outer casing and the borehole wall, resulting in increased friction and heat that may cause the casing to bind and become stuck in the borehole.

BRIEF SUMMARY OF THE INVENTION

Methods and apparatus for removing slough from boreholes are described in this application. A slough removal assembly containing a slough barrel is lowered into a borehole having excess slough, driven into the slough to cause the slough to enter the slough barrel, and the slough removal assembly is then removed along with the excess slough. The slough removal assembly may contain a shoe coupled to the slough barrel and configured to be driven into the slough, a retainer positioned between the shoe and the slough barrel to retain slough inside of the slough barrel, and a driving mechanism (such as a drop hammer) to drive the slough removal assembly into the slough. The slough removal assembly may be coupled either to a wireline system or to a drill string for insertion into and removal from the borehole.

BRIEF DESCRIPTION OF THE DRAWINGS

The following description can be better understood in light of Figures, in which.

Figure 1:
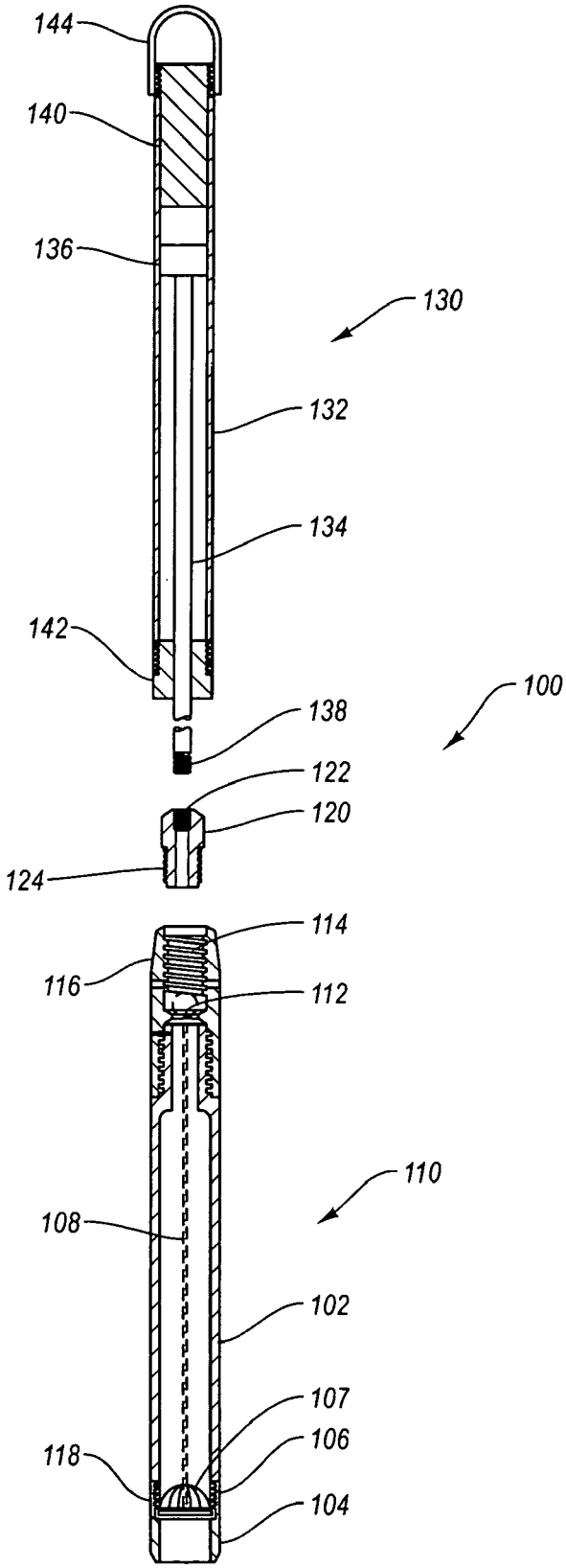
FIG. 1 illustrates an exemplary, perspective view of a slough barrel assembly.

Together with the following description, the Figures demonstrate and explain the principles of the slough removal assembly and methods for using the slough barrel assembly. In the Figures, the thickness and configuration of components may be exaggerated for clarity. The same reference numerals in different Figures represent similar, though not necessarily the same components

DETAILED DESCRIPTION OF THE PREFERRED EMBODIMENTS

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on slough removal in core sample drilling operations, the apparatus and associated methods could be equally applied in non-core sampling drilling process, such as sonic drilling systems, rotary drilling systems, percussive drill systems, etc.

Figure 2:
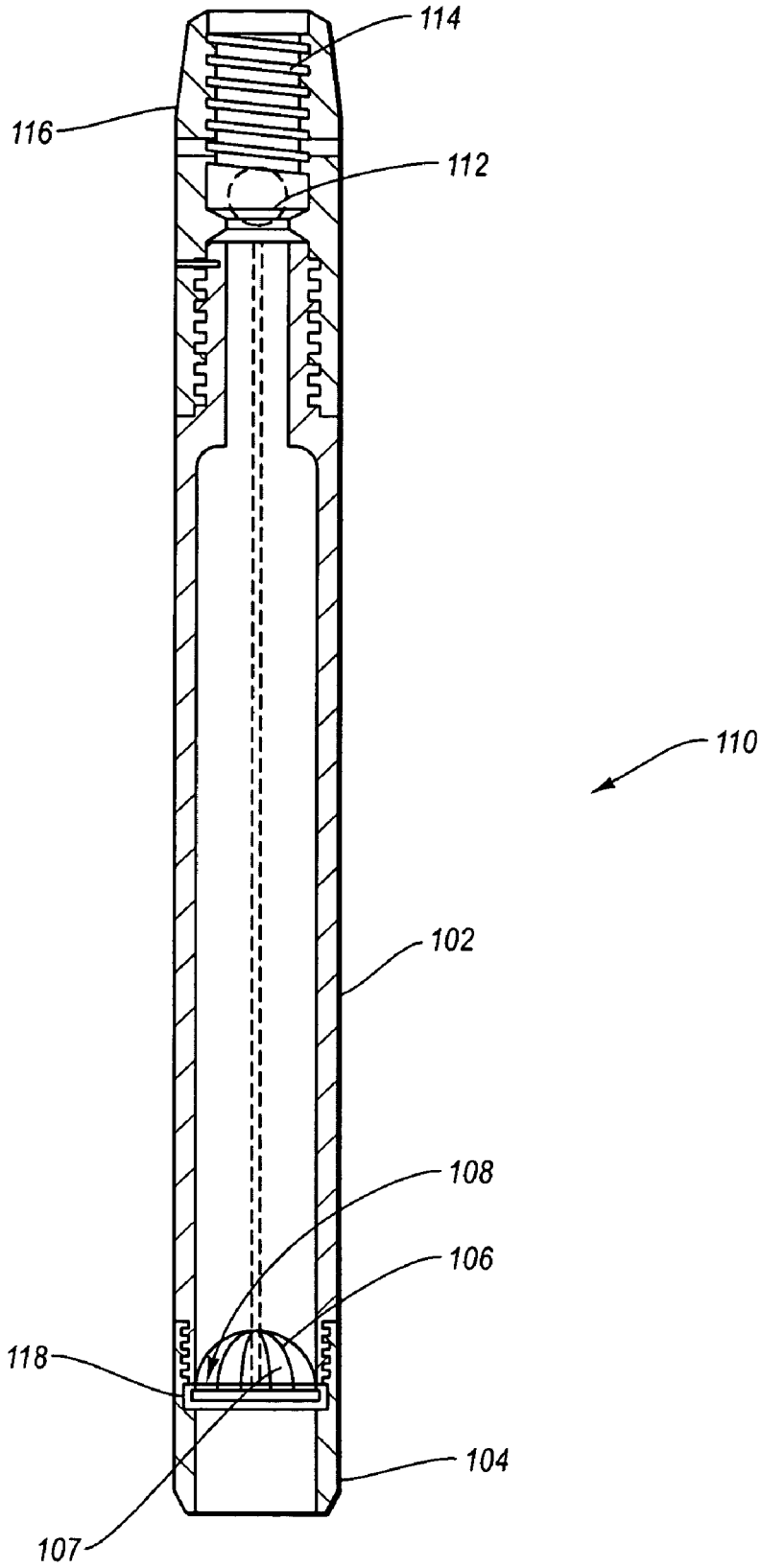
FIG. 2 illustrates a view of a portion of a slough barrel assembly.
Figure 3:
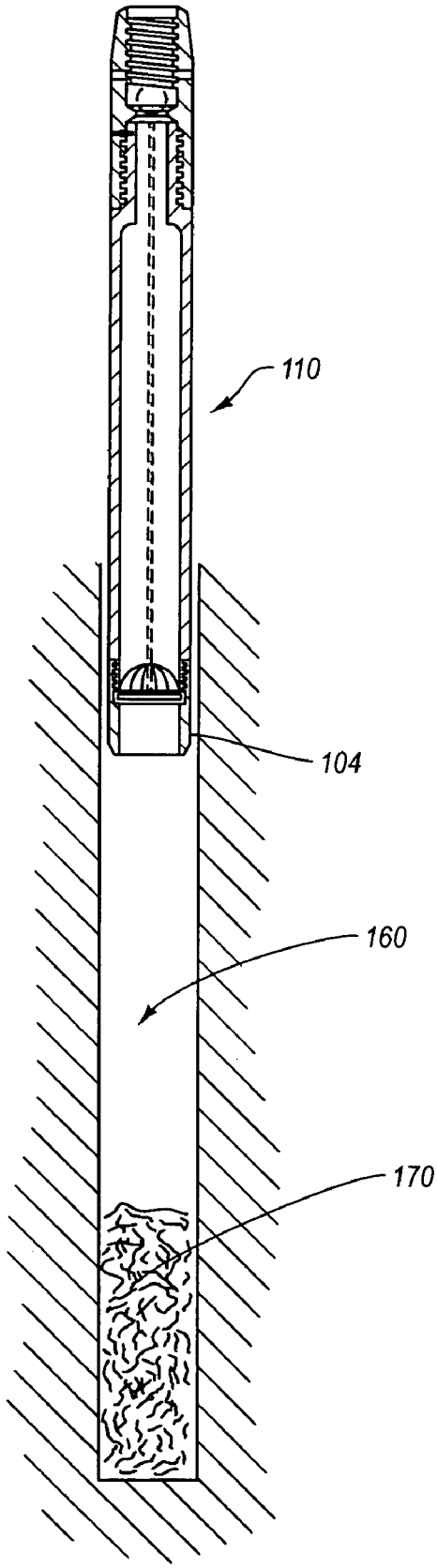
FIGS. 3-5 show various positions of a slough removal assembly during use in a borehole.

One exemplary slough removal assembly for removing slough from a borehole is illustrated in FIGS. 1-3. In these Figures, slough removal assembly 100 is used for removing slough 170 from a borehole 160. The slough removal assembly 100 illustrated in FIG. 1 may include a slough barrel 110, a drive mechanism for the slough barrel (such as drop hammer 130), and a connector 120 for these two components.

The slough barrel 110 may contain a tube 102 open at both a proximal end 116 and a distal end 118 so that the interior may be occupied by a material or liquid introduced into slough barrel 110 through the distal end 118. The tube 102 may be constructed of any material and may have any geometry that allows slough removal assembly 100 to be used as discussed herein. For example, tube 102 may be constructed of steel, composite material, or other metal alloy to allow tube 102 to withstand the force exerted on slough barrel 110 to collect slough 170 (FIG. 3) as described herein. The tube 102, for example, may have a cylindrical shape with a substantially circular cross-section.

In some embodiments, tube 102 may be a modified core sample tube. Examples of core sample tubes include a split sample tube. In some embodiments, the tube 102 can be configured to maximize the interior volume of the tube, thereby allowing it to remove a maximum amount of slough 170 during use. Thus, the strength required for tube 102 may be less than the strength of a conventional core sample tube since this allows for the greater interior volume that can be needed. The tube 102 may be of various lengths and widths, depending on the desired amount of slough 170 to be removed.

The tube 102 may be coupled at distal the end 118 to a shoe 104. The shoe operates to facilitate penetration of slough removal assembly 100 into slough 170. Any device achieving this function may be used as the shoe, including any known drill bit. In the embodiments where the formation comprises loose material, the shoe can be annular in shape with a beveled distal end. The beveled distal end of the shoe 104 may be sufficiently sharp to facilitate penetration of slough removal assembly 100 into the loose material of the slough 170 (FIG. 3).

The shoe 104 may be coupled to the tube 102 in any manner, [such as by welding, pins, clamps, etc.] For example, the shoe 104 and the tube 102 can be coupled using threads (as illustrated in FIGS. 1 and 2). In some embodiments, the shoe 104 may be integrally formed with the tube 102.

The slough barrel 110 can also contain a retainer 106 that holds or retains the slough within the slough barrel 110. Any device known in the art for this purpose can be used, such as a ball valve, cuspid valve, butterfly valve, or any other suitable retaining mechanism. In other embodiments, though, the retainer 106 may not be needed as the material of the slough 170 (FIG. 3) may be of a composition and/or consistency that would not need any apparatus to be retained in the tube 102.

The retainer 106 may be positioned between the tube 102 and the shoe 104 such that retainer 106 is held in the open central channel of the tube 102. As shown in FIGS. 1 and 2, retainer 106 may include a basket retainer having several fingers 107. The fingers 107 may be biased into the position shown in FIGS. 1 and 2 to form a semi-spherical body. The base of the fingers 107 can be located adjacent the walls of tube 102. The fingers 107 extend toward a center axis 108 of tube 102 so that the tips of the figures are adjacent each other in the middle of the tube 102.

The fingers 107 flex upwardly to allow slough 170 to enter the tube 102 through the shoe 104 when sufficient force is applied to a bottom (the concave portion) of retainer 106, such as slough 170 is forced upwardly through the bottom as the slough barrel 110 is forced downward into the slough. The hemi-spherical design of retainer 106 retains any material in tube 102 from exiting the distal end 118 by returning to the biased position when a force is applied from the interior of tube 102 rather than through the shoe 104, such as when gravity attempts to force slough 170 downwards as the slough barrel 110 is lifted. The retainer 106 may be made of any suitable material, such as for example, plastic or other synthetic material sufficient to be flexible and yet hold slough 170 in tube 102.

The tube 102 may optionally contain a check valve 112 near the proximal end 116 of tube 102. The check valve 112 may allow fluid, gases, and other low density materials to exit tube 102 upwardly and thereby provide space in tube 102 for the slough. At the same time, the check valve 112 prevents higher density materials from exerting a downward force on the contents of tube 102 (i.e., the slough 170), thereby allowing the maximum amount of internal space in the tube 102. For example, in some drilling operations, the borehole 160 and tube 102 may be filled with fluid prior to introducing the slough removal assembly to penetrate the slough 170. The check valve 112 allows this fluid to exit tube 102 without exerting constant downward or static hydraulic pressure on the interior of tube 102. Thus, check valve 112 allows excess fluid an escape path out of tube 102 and makes the slough removal assembly 100 easier to withdraw from the borehole 160.

The slough barrel 110 also contains a coupling portion 114 to allow slough barrel 110 to be connected to other components of slough removal assembly 100, or to other drilling components (i.e., a drill string or a wireline system). Any known apparatus that operates the connecting portion 114 can be used. The coupling portion 114 may be contained in the proximal end 116 of tube 102 to allow the slough barrel 110 to be connected to other components of the slough removal assembly 100. As illustrated in FIG. 1, while the coupling portion 114 can be threaded to provide the connection, any other known connection device can be used, such as a pin, locking ring, etc.

The slough removal assembly 110 can also contain a connecting apparatus in some embodiments. The type of connecting apparatus used may depend on what component the slough barrel is connected to. In at least one example, the connecting apparatus indicates a connector 120 as illustrated in FIGS. 1-2. The connector 120 may be coupled to the coupling portion 114 of slough barrel 110. As illustrated in FIG. 1, the connector 120 allows connection of a driving mechanism (i.e., the drop hammer 130 described below) to the slough barrel 110. The connector 120 may include a coupling portion 122 that is compatible with the drop hammer 130 and a coupling portion 124 that is compatible with the coupling portion 114 of slough barrel 110. In other examples, the connector 120 can be configured to facilitate connection to other drill components, such as a drill string, to a wireline, or any other component.

The slough removal assembly 100 also contains a drive mechanism for the slough barrel 110. The drive mechanism may be included in slough removal assembly 100 to drive the shoe 104, and subsequently the tube 102, into the slough 170. Any known apparatus operating in this manner can be used, including a drill rod or a drill string. In some embodiments, the drop hammer 130 illustrated in FIGS. 1-2 is used as the drive mechanism. The drop hammer 130 contains an outer tube 132, inner rod 134, anvil 136, hammer weight 140, stop 142, and wireline connector 144. The drop hammer 130 functions when the wireline connector 144 is lifted, thereby raising hammer weight 140 along with outer tube 132 and stop 142 relative to inner rod 134, until anvil 136 contacts stop 142. The hammer weight 140 is then allowed to drop. The hammer weight 140 builds momentum as it falls, delivering a force to anvil 136 which is transferred to rod 134 and through slough barrel 110 to shoe 104. If needed, the hammer weight 140 may be repeatedly lifted and dropped until the shoe 104 penetrates to the desired depth of the borehole.

The slough removal assembly described above can be used in any method for removing the slough in a borehole. In some embodiments, the slough removal assembly can be used to remove the slough that comprises material which has already been removed from the formation during the drilling process. In other embodiments, though, the slough removal assembly can be used to remove not only this loose slough, but also to scrape the walls of the borehole to remove material that has been loosened during the drilling process, but is still attached to the borehole wall. This scraping function can be useful when it is desired to smooth the walls of the borehole.

Figure 4:
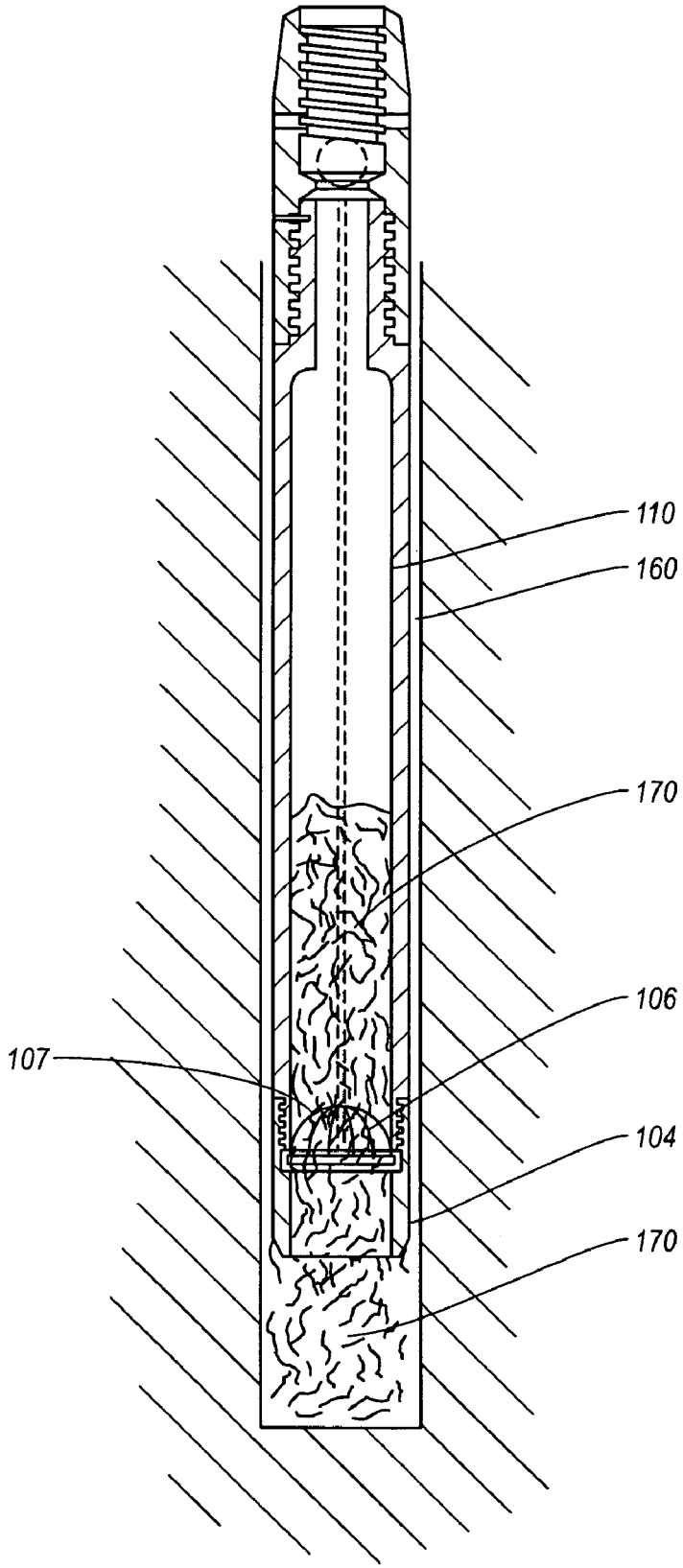
Figure 5:
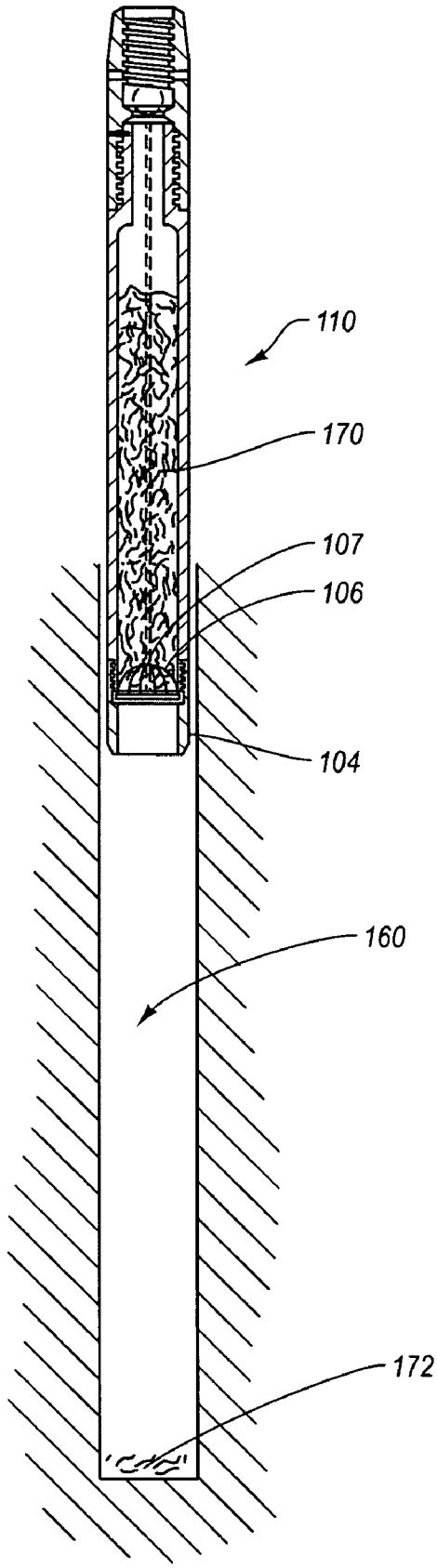

FIGS. 3-5 illustrate one method of using the slough removal assembly 100 to collect and withdraw slough 170 from a borehole 160. As described above, during core sampling operations, slough 170 may be produced by loose walls or by material that has been cut from the formation by a drill bit. The slough 170 then typically collects in the bottom of the borehole 160. To remove the slough 170 from the borehole 160, the slough barrel 110 is introduced into the borehole 160 down to the level of the slough 170 as shown in FIG. 3. Once the slough barrel 110 contacts the slough 170 and ceases to move any further into borehole by gravity alone, slough barrel 110 may be driven into slough 170 using the drop hammer 130 (FIG. 1).

As shown in FIG. 4, as the slough barrel 110 penetrates the slough 170, this material passes through the retainer 106 and into the tube 102. Once the slough barrel 110 either reaches the bottom of borehole 160, or the tube 102 of the slough barrel 110 is full, the slough barrel 110 may be withdrawn from borehole 160 (as shown in FIG. 5). The slough 170 is held in slough barrel 110 by retainer 106, allowing slough 170 to be removed from borehole 160 while the material of the slough is held in the slough barrel 110. In some instances, some residual slough 172 may remain in borehole 160. Depending on the amount of residual slough 172, the process for removing the slough 170 may be repeated to remove the residual slough 172.

Following removal of the slough, the core sampling operation can then continue to increase the depth of the borehole (beyond that depicted in the Figures). Again, during this core sampling process, additional slough will be produced. The additional slough and this increased depth will also be removed using a similar process to that described immediately above. The core sampling operation and slough removal process can be repeated as many times as needed.

In some embodiments, the advancement of the slough barrel 110 may be assisted by any known drilling apparatus and methods. For example, the slough barrel 110 may be rotated to penetrate the slough 170, such as in a rotary drilling operation. Similarly, slough barrel 110 may be driven to penetrate slough 170 using a sonic drilling process.

The method and apparatus for slough removal described in this application may be used with any conventional drilling components and is not limited to the components specifically described in this application. For example, while the drop hammer 130 is described as containing a wireline connector 144 for a wireline system, it could be modified to connect to any other retrieval system, such as a drill string, by replacing the wireline connector 144 with threads that match the threads of a drill rod that is the bottom part of a drill string.

The slough removal assembly 100 and methods for removing slough described above are described with reference to a generally vertical borehole 160. It will be appreciated that the slough removal assembly and methods could be used in any drilling configuration, such as horizontal drilling, or even any drilling angle between vertical and horizontal.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

What is claimed is:

1. A method of obtaining core samples that minimizes contamination of the core samples by intermittently removing slough from a borehole, comprising:

drilling a bore hole using a core barrel;

capturing a core sample within the core barrel;

retrieving the core barrel and captured core sample from the bore hole using a wireline;

lowering a slough removal assembly into the borehole, the slough removal assembly including: (i) a slough barrel including a retainer adapted to allow slough to pass into, but not out of, a distal end of the slough barrel, and (ii) a shoe secured to the distal end of the slough barrel;

driving the slough removal assembly into the borehole so that slough is introduced into the slough barrel of the slough removal assembly by passing through the retainer;

withdrawing the slough removal assembly and the captured slough from the borehole using a wireline;

drilling the bore hole to a further depth using a core barrel;

capturing an additional core sample within the core barrel; and retrieving the core barrel and the captured additional core sample from the bore hole using a wireline.

2. The method as recited in claim 1, further comprising providing the slough removal assembly with:

a drop hammer coupled to the proximal end of the slough barrel; and a retrieval section coupled to the drop hammer.

3. The method as recited in claim 2, further comprising driving the slough barrel by using the drop hammer.

4. The method as recited in claim 2, further comprising placing and withdrawing the slough removal assembly by using a wireline system that can be coupled to the retrieval section.

5. The method as recited in claim 2, wherein the shoe is configured to drive through the slough in the borehole so it is forced into the slough barrel.

6. The method as recited in claim 1, further comprising retaining the slough in the slough barrel while it is withdrawn.

7. The method as recited in claim 6, wherein the retaining is performed by the retainer that is biased to allow slough to move into the tube member but not out of the tube member.

8. A method of removing slough from a borehole to minimize the contamination of core samples, comprising:

drilling a bore hole;

lowering a slough removal assembly into the borehole, the slough removal assembly, including:

a tube member, a shoe attached to, and extending distally away from, a distal end of the tube member, and a retainer secured within the distal end of the tube member, driving the tube member into slough in the borehole using a driving device attached to the proximal end of the tube member so that the tube member penetrates the slough and captures slough therein;

withdrawing the slough removal assembly from the bore hole using a wireline retrieval section coupled to the driving device;

introducing a core barrel into the borehole;

capturing a core sample within the core barrel; and withdrawing the core barrel from the borehole.

9. The method as recited in claim 8, wherein the driving device comprises a drop hammer.

10. The method as recited in claim 8, wherein the retainer is configured to hold slough in the tube member.

11. The method as recited in claim 8, further comprising introducing and withdrawing the slough removal assembly by using a wireline system that can be coupled to the wireline retrieval section.

12. A slough removal assembly to remove slough from a borehole, comprising:

a tube member;

a shoe attached to, and extending distally from, a distal end of the tube member;

a retainer adapted to allow slough to pass into, but not out of, a distal end of the tube member, the retainer being secured to the distal end of the tube member;

a check valve secured within a proximal end of the tube member, the check valve being configured seal off the proximal end of the tube member thereby preventing at least a portion of the slough from passing out of the distal end of the tube member;

a driving device attached to the proximal end of the tube member and configured to apply force to the tube member so that the tube member can penetrate slough; and a wireline retrieval section coupled to the driving device.

13. The slough removal assembly as recited in claim 12, wherein the driving device comprises a drop hammer.

14. The slough removal assembly as recited in claim 12, wherein the shoe is configured to drive through slough in a borehole so it is forced into the tube member.

15. The slough removal assembly as recited in claim 12, wherein the retainer comprises fingers configured to hold slough in the tube member.

16. The slough removal assembly as recited in claim 15, wherein the check valve comprises a ball.

17. A drilling system containing a slough removal assembly to remove slough from a borehole, the slough removal assembly comprising:

a tube member;

a shoe attached to a distal end of the tube member;

a retainer adapted to allow slough to pass into, but not out of, a distal end of the tube member, the retainer being secured to the distal end of the tube member;

a check valve secured within a proximal end of the tube member, the check valve being configured seal off the proximal end of the tube member thereby preventing at least a portion of the slough from passing out of the distal end of the tube member;

a driving device attached to a proximal end of the tube member and configured to apply force to the tube member so that the tube member can penetrate the slough; and a wireline retrieval section coupled to the driving device.

18. The drilling system as recited in claim 17, wherein the driving device comprises a drop hammer.

19. The drilling system as recited in claim 17, wherein the shoe is configured to drive through slough in a borehole so it is forced into the tube member.

20. The drilling system as recited in claim 17, wherein the retainer includes fingers configured to hold slough in the tube member.

21. A method for drilling, comprising:

creating a borehole in a formation by drilling to a first depth, the borehole containing slough;

introducing a slough removal assembly in the borehole, the slough removal assembly including: (i) a slough barrel including a retainer adapted to allow slough to pass into, but not out of, a distal end of the slough barrel, and (ii) a shoe secured to the distal end of the slough barrel;

driving the slough removal assembly into the borehole so that slough is introduced into a slough barrel of the slough barrel assembly;

withdrawing the slough removal assembly from the borehole;

lowering a core barrel into the borehole;

capturing a core sample within the core barrel; and withdrawing the core barrel from the borehole.

22. The method as recited in claim 21, further comprising creating the borehole by drilling to obtain a core sample.

23. The method as recited in claim 22, wherein the slough is left in the borehole after the core sampling is finished.

24. The method as recited in claim 23, wherein the retainer includes a plurality of fingers that is biased to allow slough to move into, but not out of, the slough barrel.

25. The method as recited in claim 24, further comprising introducing and withdrawing the slough removal assembly by using a wireline system.

26. The method as recited in claim 24, further comprising extending the borehole to a second depth by drilling to obtain a core sampling.

27. The method as recited in claim 26, further comprising repeating the process of removing any slough created by drilling to the second depth by using the slough barrel assembly.

* * * * *